US009541359B2

(12) United States Patent
Pedersen

(10) Patent No.: US 9,541,359 B2
(45) **Date of Patent: *Jan. 10, 2017**

(54) CROSSWIND RESISTANT FLETCHING CONSTRUCTION

(71) Applicant: Out RAGE, LLC, Cartersville, GA (US)

(72) Inventor: William E. Pedersen, Duluth, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/699,446

(22) Filed: Apr. 29, 2015

(65) Prior Publication Data

US 2015/0268014 A1 Sep. 24, 2015

Related U.S. Application Data

(63) Continuation of application No. 13/998,212, filed on Oct. 11, 2013, now Pat. No. 9,046,330.

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | |
|---|---|---|---|---|
| 2,796,262 | A | 6/1957 | Folberth, Jr. | |
| 4,003,576 | A | 1/1977 | Carella | |
| 4,468,189 | A | 8/1984 | Carella | |
| 4,488,728 | A | 12/1984 | Humphrey | |
| 5,423,553 | A | 6/1995 | Krieg | |
| 5,613,688 | A | 3/1997 | Carella | |
| 6,958,023 | B2 | 10/2005 | Simo et al. | |
| 7,485,057 | B2 | 2/2009 | Afshari | |
| 8,105,189 | B1 * | 1/2012 | Huang | F42B 6/06 473/586 |
| 9,046,330 | B2 * | 6/2015 | Pedersen | F42B 6/06 |
| 2003/0045381 | A1 | 3/2003 | Morris et al. | |

FOREIGN PATENT DOCUMENTS

CN 103185487 A 7/2013

OTHER PUBLICATIONS

International Search Report for PCT/US2014/059732, Jan. 5, 2015.
Written Opinion of the International Search Authority for PCT/US2014/059732, Jan. 5, 2015.
Search Report for Taiwanese Application No. 103134792, dated Sep. 2, 2015.

* cited by examiner

*Primary Examiner* — John Ricci
(74) *Attorney, Agent, or Firm* — Covington & Burling LLP; Gregory S. Discher; Grant D. Johnson

(57) ABSTRACT

A molded aerodynamically crosswind resistant fletching includes pairs of spaced apart fletchings having distal edges bowed inwardly towards each other thus to deflect crosswinds over the tops of the fletchings.

13 Claims, 5 Drawing Sheets

CROSSWIND RESISTANT FLETCHING CONSTRUCTION

CROSS-REFERENCE TO RELATED APPLICATIONS

This application is a continuation, and claims the benefit under 35 U.S.C. §120, of U.S. patent application Ser. No. 13/998,212, filed on Oct. 11, 2013, which is herein incorporated by reference in its entirety.

FIELD OF THE INVENTION

This invention relates to archery and more particularly to a molded aerodynamically crosswind resistant fletching construction to counter the effects of crosswind on arrows and bolts.

BACKGROUND OF THE INVENTION

Molded fletchings are common in the archery industry and have been applied to both arrows and bolts for bow hunting. One such molded configuration is available from Outer Limit which provides pre-molded fletchings around a cylindrical carrier which is slipped over the arrow shaft. It is noted that the goal of the fletching is to produce sufficient drag to be able to stabilize the arrow in flight and to be able to control the proper amount of spin of the arrow. Note that the fletchings must be of a sufficient size to produce sufficient drag. The fletchings can also be angled with respect to the center line of the arrow shaft to be able to produce the desired amount of spin. Normally three straight pieces of plastic are used as fletchings mounted on a cylindrical carrier.

Whether the fletchings are mounted aligned with the center line of the arrow shaft or are canted to provide a rotation of the arrow in flight, when there is a crosswind, the trajectory of the arrow is such that the arrow does not go in the direction that it is originally aimed. When the wind catches these fletchings from the side the arrow is deflected off course. Most importantly, what can happen is that the arrow spin can stall. Thus the crosswind can actually stop the arrow from spinning. Moreover the force of the crosswind pushing on the arrow sideways causes the arrow to fly off course and miss the target. Thus the aerodynamic properties of straight molded fletchings are such as to be particularly sensitive to crosswinds.

SUMMARY OF INVENTION

Molded fletchings are provided in pairs about a central shaft, with the outward tips of the pair of the fletchings bowed inwardly so as to present a minimal area to crosswinds rather than catching the fletchings from the side. The result is that the crosswinds flow over the bowed-in tips of the fletchings resulting in minimum sideways thrust.

It will be noted that the aerodynamics of the fletchings are critical to the performance of an arrow as it flies through the air. The two most important aerodynamic characteristics are the drag and the spin created by the fletching. An appropriate amount of drag is desirable in order to create sufficient flight stabilization so that the arrow remains pointed forward during flight. This is ensured by having fletchings near the trailing end of the arrow that drag as they fly through the air, resulting in a force pulling backward on the trailing end of the arrow, and therefore keeping it oriented correctly. Too much drag is not desirable because that will result in excess air resistance and increased drop of the arrow trajectory as it flies toward its intended target.

The drag created by the fletchings are the result of two phenomena:

First, skin friction from air flowing over the surfaces of the fletchings viscously creates a drag force on those surfaces. This is largely a function of the surface roughness and surface area of the fletchings.

Secondly, drag pressure results from the high pressure at the leading edges of the fletchings, and low pressure areas at the trailing edges of the fletching surfaces.

It has been found that by having six vanes, it is possible to create an increased amount of drag when compared with conventional fletchings that only have three fletching "wings". Therefore, it is possible to create the desired amount of drag with less volume taken up by the fletchings. This reduces the size of fletchings necessary, and therefore reduces the effect of a side wind pushing sideways on the fletchings.

As to stabilization; spin stabilization is a well-documented phenomena and is demonstrated commonly in things such as bicycle tires and bullet trajectories. Arrows are similarly spin stabilized by controlling the amount of spin caused by the fletchings. Spin is primarily created in two ways from the design of the subject fletchings.

As viewed from a side view of the fletchings, looking radially inward at the system, the fletchings are molded so that they create a spiral pattern axially down the arrow shaft that induces spin as the arrow flies through the air.

This being said, if the fletchings are molded such that they are produced as a sheet having rounded edges on the tip of the fletchings, crosswind is directed across the fletchings as opposed to catching the side of the fletching. It therefore flows over the fletchings when the wind comes from the side, thus minimizing trajectory drift.

Note there is very little air flow in the valley between the pairs of fletchings. Tests have shown that when the subject configuration is used, crosswinds of up to 20 miles per hour do not noticeably impact the trajectory of the arrows.

In a preferred embodiment the pairs of fletchings are bowed inwardly such that wind coming from any direction flows around rather than catching on the fletching. This is quite unlike the current straight fletching designs. Note that the fletchings can be aligned along the longitudinal axis of the arrow at which point the arrow does not naturally spin, whereas the fletchings may be spirally configured along the arrow shaft and angled with respect to the longitudinal axis of the arrow such that the arrow spirals through the air. While the subject fletchings have been designed to spiral through the air it is the ability to deflect crosswind that is critical to the present invention.

In one embodiment pairs of fletchings are arranged around a cylindrical carrier such that three pairs of fletchings are provided for a total of six fletchings. Each pair of fletchings is designed to work in tandem with each other to direct crosswind over the fletchings.

The feature of the fletchings that allow it to drag air flow over the tips of the fletching is due to the curved outer tip of the fletchings which have a radius. When the crosswind impacts the top of the fletching what normally happens with traditional fletchings is that wind strikes the fletching with sufficient force to begin pushing the fletching to the lee side of the wind.

On the other hand the subject fletching design with the tips bowed inwardly tends to direct the air flow around and over the fletching as opposed to impacting its sides. Therefore side drag force is significantly less and the fletchings reduce the side forces.

In one embodiment each of the fletchings has a humped central region which serves to create more of an air flow shape to create more spin on the fletching. This is because the hump is in essence in the direction of rotation.

The so-called hump in the middle of the fletching is also to provide structural rigidity. Also, when the fletchings are two part fletchings as might be the case when utilizing a light lighted nock with an opaque forward portion and a transparent rear portion, the humps provide internal channels within the fletching so as to be able to attach a rearward portion of a fletching to the forward portion by means of forward facing prongs on the rearward portion.

By reducing the amount of side wind caught by the fletchings, the rotational spin of the arrow is largely unaffected. Note, traditionally fletched arrows see a marked decrease in spin in a side wind to the point that their rotation may stop completely. However, the subject fletchings in molded pairs direct the air flow over their shape which has shown virtually no reduction in rotational velocity at all. By maintaining a more stable spin rate when compared with traditional fletchings, the arrow spin stabilization is greatly improved with less variability.

In summary, it has been found that by locating pairs of fletchings about a central shaft and by having the tips of opposed fletchings directed inwardly, the effect of crosswinds is minimized as the crosswinds will tend to go up and over the fletchings as opposed to catching the fletchings. The result is that the trajectory of the arrow or bolt is not affected by crosswinds up to as much as 20 miles per hour.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
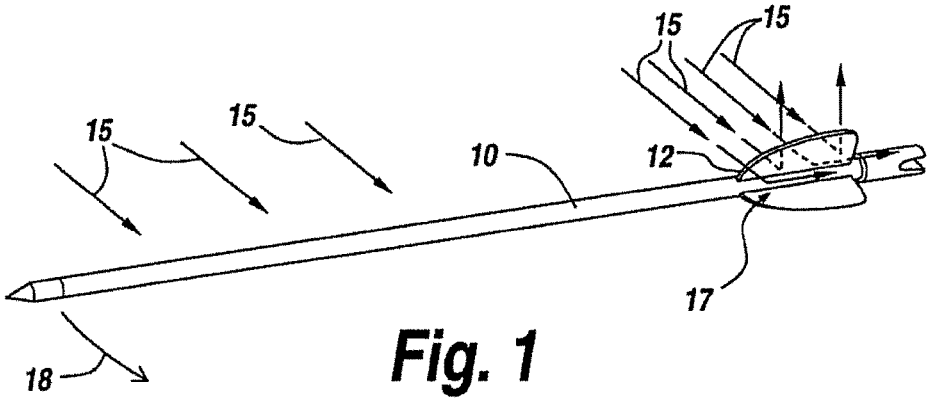
Fig. 1 Prior Art
FIG. 1 is a diagrammatic illustration of the flight of an arrow with conventional fletchings which is deflected off course by crosswinds.

Referring now to FIG. 1, a typical arrow or bolt 10 is provided with flat fletchings 12 located about the arrow shaft. With a crosswind as illustrated at 16 the crosswind impacts and catches the fletchings so as to decrease rotational velocity as well as causing the arrow to go off course as illustrated by arrow 18, whereupon the crosswind causes the arrow to miss its target. Here it can be seen that crosswind 15 gets into the valley 17 between the fletchings which can reduce rotational velocity.

Figure 2:
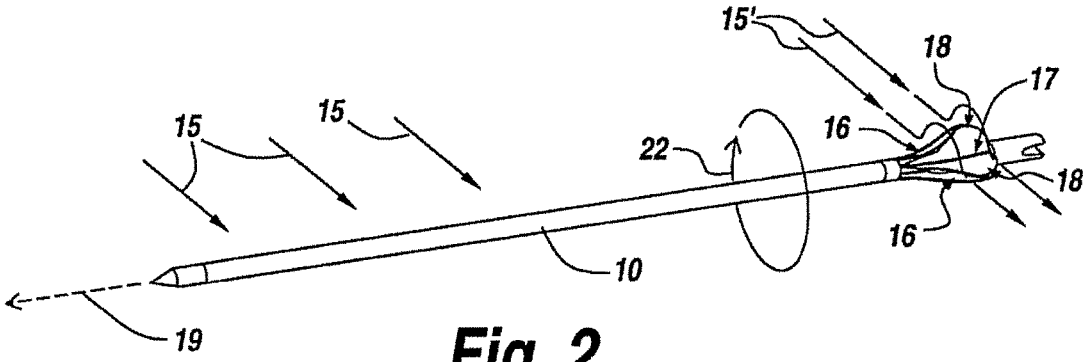
FIG. 2 is a diagrammatic illustration of an arrow manufactured in accordance of the subject invention in which a crosswind does not affect arrow flight, with the fletchings configured to provide rotation of the arrow, and direct side wind over their profile rather than catching the side wind.

Referring to FIG. 2, if arrow 10 is provided with pairs of fletchings 16 and 18 then it will be shown that crosswind 15 does not divert the arrow from its original intended track as illustrated by dotted arrow 19. Rather as shown at 15' the crosswind goes over the tips of the fletchings and does not pass into valley 17. Moreover, the aerodynamic shape of the fletchings as will be described causes the arrow to rotate as illustrated by arrow 22 so as to provide the arrow with a spin which improves projectile tracking. The side wind does not cause a significant reduction in rotational velocity with this improved fletching profile.

Figure 3:
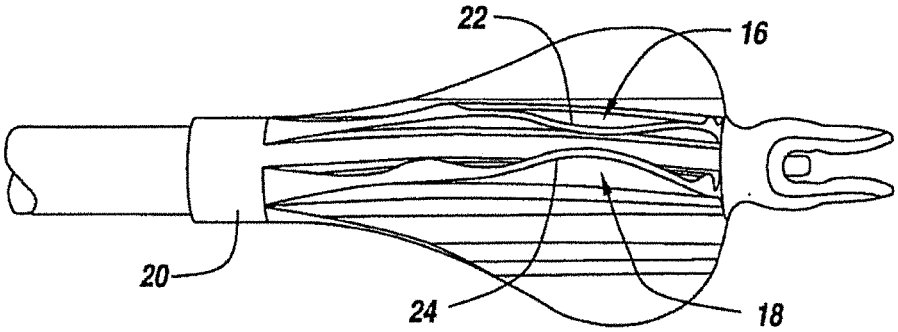
FIG. 3 is a diagrammatic side view of one embodiment of the pairs of fletchings that are utilized in the subject invention with the tips of the pairs of fletchings being bowed inwardly towards each other minimize crosswind effect.

Referring now to FIG. 3, pairs of fletchings 16 and 18 are mounted on a cylindrical carrier 20, with the tips 22 and 24 of the fletchings bowed inwardly as illustrated. This inward configuration provides that crosswinds do not affect arrow trajectory as in the case of normal molded fletchings. This is because the crosswinds do not get into the channel or valley between the fletching pairs, and is directed around the periphery of the fletchings rather than catching it on the traditional flat side profile of traditional fletchings.

Figure 4:
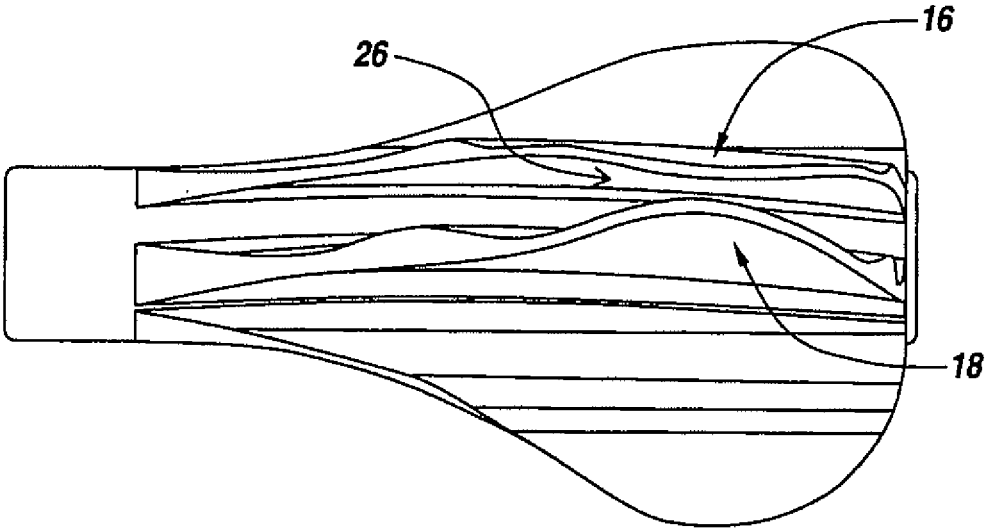
FIG. 4 is a diagrammatic illustration of the molded fletchings of FIG. 3 wherein the bowed-in tips of the fletchings show a small gap between the tips of the fletchings at their distal edges.
Figure 5:
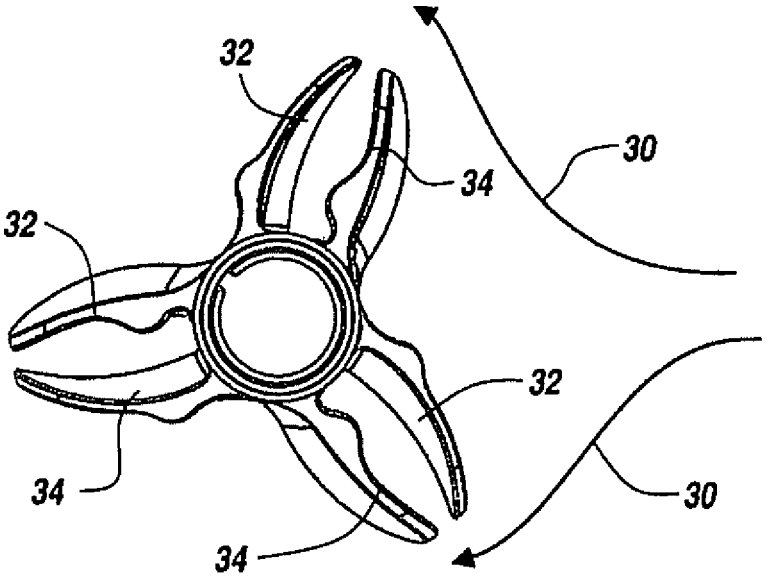
FIG. 5 is a diagrammatic illustration of the fletching configuration of FIG. 4 showing that with the tips of the fletchings bowed inwardly crosswinds tend to go out and over the fletchings as opposed to catching the fletchings to drive an arrow off course.

Referring to FIG. 4, the inward bow of the fletchings 16 and 18 is shown such that the valley or slot 26 between the tips of the bow's fletchings is indeed quite narrow. It will be shown that when a crosswind impinges on these fletchings, the crosswind as illustrated in FIG. 5 at 30 rather than pushing on the interior portions 32 and 34 of the pairs of fletchings rather is deflected around the tips so as not to affect arrow trajectory or rotational velocity.

Figure 6:
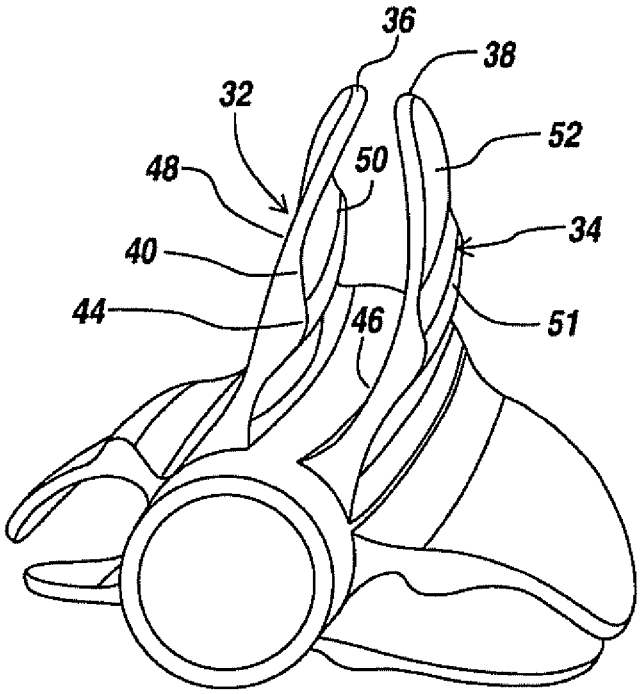
FIG. 6 is a diagrammatic illustration of one of the pairs of fletchings showing the spiral aerodynamic shape which causes rotation of the arrow as it passes through the air.

Referring to FIG. 6, a diagrammatic illustration of molded fletchings 32 and 34 indicate that the tips 36 and 38 are indeed quite closely spaced. However the curvature of the opposed pairs of fletchings is first that the interior surface 40 of fletching 32 is provided with a hump or raised portion 44 which faces interior surface 46 of fletching 34. This configuration provides structural stability of the Retellings and for aerodynamic lift at the exterior portion 48 of fletching 32. This also provides a vacuum or lower pressure on surface 50 of fletching 32. Likewise, the hump or raised portion 51 on fletching 34 provides structural stability of this fletching. Also, the result of the pressure differential causes rotation of the fletchings and the associated arrow shaft especially when the fletching spiraled along the arrow shaft as shown in FIGS. 6 and 8.

Figure 7:
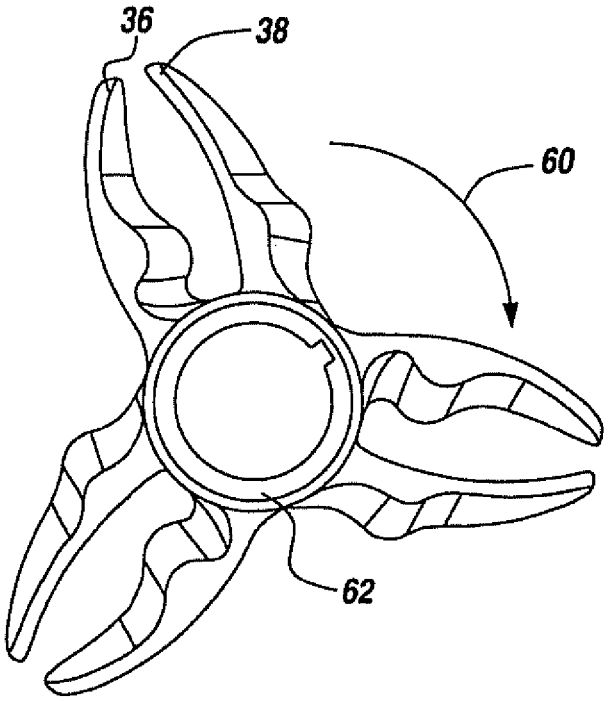
FIG. 7 is a diagrammatic illustration of the effect of the aerodynamic shape of the pairs of fletchings which provide an air foil to cause rotation of the arrow or bolt.

This rotation is shown in FIG. 7 by arrow 60 such that not only is the arrow protected from crosswinds due to the close spacing of tips 36 and 38, it also causes the entire shaft assembly here shown at 62 to rotate as illustrated by arrow 60 due to the spiraling of the fletchings.

The net result is a molded fletching configuration with inwardly bowed tips for pairs of fletchings which causes crosswinds, rather than catching the fletching, to be diverted across the fletchings, therefore only minimally impacting the arrow or bolt trajectory or rotational velocity.

Figure 8:
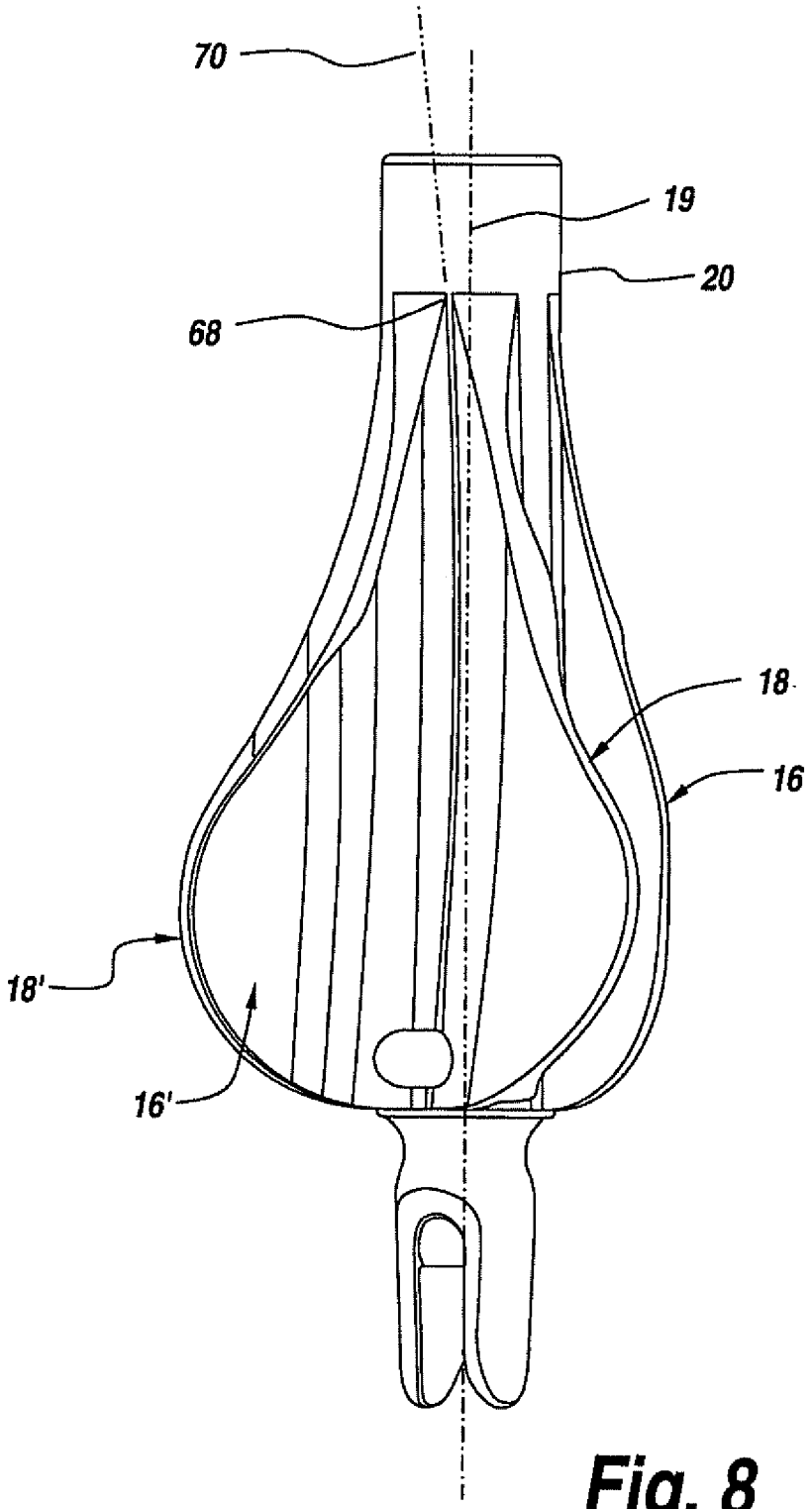
FIG. 8 is a diagrammatic representation of the spiral fletching configuration for the fletchings of FIG. 6.

Referring now to FIG. 8, what is shown is a side view of the paired fletchings in which the surface of the fletchings are arranged in a spiral. Here it can be seen that fletchings 16 and 18, as well as 16' and 18' are spiraled around center line 19 such that for instance the leading point 68 of fletching 18 is offset from center line 19 as can be seen by dotted line 70.

This isometric drawing shows the spiraling of the fletchings in a clockwise direction around center line 19, with the spiraled configuration providing for arrow rotation as the arrow flies through the air.

Figure 9:
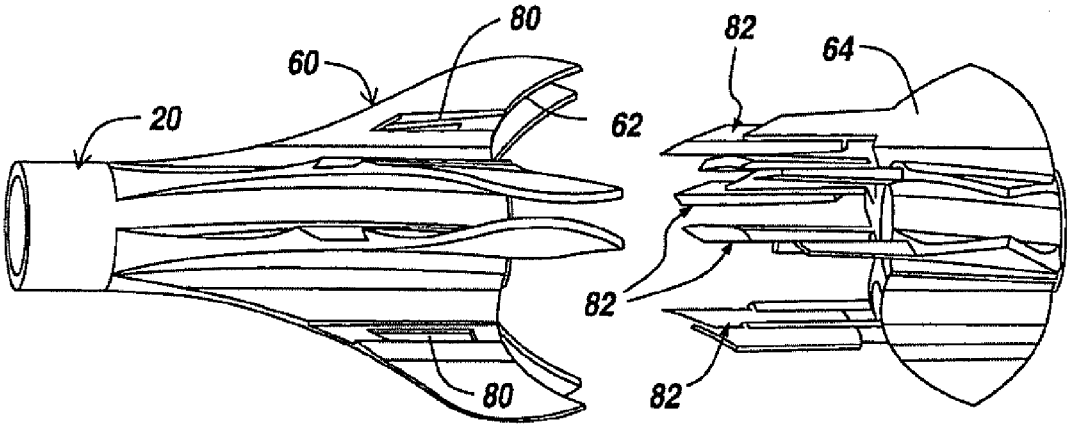
FIG. 9 is an exploded view of a two part fletching in which the rear part is inserted into and locked to the forward part, used for instance for lighted fletchings.

Referring now to FIG. 9, in one embodiment a two part fletching include a forward portion 60, and a rear portion 64 adapted to be inserted into the forward portion.

Here the distal edge 62 of forward portion 60 is parabolic to provide a parabolic interface between the two portions. The portions are joined together when prongs or pins 78 are inserted into corresponding slots 80 in toward portion 60. This two part fletching construction can be used for lighted fletchings, with the forward portion 60 opaque and the rear portion 64 transparent. The two portions of the fletchings in FIG. 9 can be molded together in some embodiments, or post assembled in others.

When used with a lighted nock, light from the nock is injected into the fletching where it is injected by the parabolic interface 62 back out the arrow. Stray light in the transparent portion makes this portion of the fletching glow such that a hunter can easily locate the arrow.

While the present invention has been described in connection with the preferred embodiments of the various figures, it is to be understood that other similar embodiments may be used or modifications or additions may be made to the described embodiment for performing the same function of the present invention without deviating therefrom. For example, three pairs of fletchings have been shown in the figures, but other numbers of fletching pairs could also be used without deviating from the present invention. Therefore, the present invention should not be limited to any single embodiment, but rather construed in breadth and scope in accordance with the recitation of the appended claims.

What is claimed is:

1. An apparatus for resisting a crosswind effect on an arrow with fletchings, comprising:

an arrow; and pairs of fletchings spaced around a central shaft of the arrow, wherein each pair of fletchings comprises vertically rising surfaces with tips which are arched inwardly towards each other, such that each of the fletchings is bowed inwardly towards the other fletching in the pair of fletchings.

2. The apparatus of claim 1, wherein the fletchings present minimal area to crosswinds while at the same time directing the flow of the crosswinds around the arrow when the arrow is in flight.

3. The apparatus of claim 1, wherein the apparatus comprises at least three pairs of fletchings.

4. The apparatus of claim 1, wherein the pairs of fletchings are mounted to the central shaft of the arrow, and wherein the fletchings spiral along the central shaft of the arrow from a proximal end of the arrow to a distal end of the arrow.

5. The apparatus of claim 4, wherein the spiraling fletchings cause the arrow to rotate when the arrow is in flight.

6. The apparatus of claim 1, wherein each pair of fletchings comprises a space between the pair of fletchings.

7. The apparatus of claim 6, wherein the space between the pair of fletchings is narrowest at the tips of the pair of fletchings.

8. The apparatus of claim 7, wherein the narrow space between the tips of the pair of fletchings prevents crosswinds from entering the space between the pair of fletchings when the arrow is in flight.

9. The apparatus of claim 1, wherein each of the fletchings comprises a raised portion.

10. The apparatus of claim 9, wherein the raised portion is a hump in a central portion of the fletching.

11. The apparatus of claim 1, wherein each of the fletchings is a two-part fletching comprising a forward portion and a rear portion.

12. The apparatus of claim 11, wherein the forward portion is joined to the rear portion with prongs or pins.

13. The apparatus of claim 11, wherein the two-part fletchings are lighted fletchings, and wherein the forward portion is opaque and the rear portion is transparent.

* * * * *